United States Patent [19]

Jourdan et al.

[11] 3,948,486

[45] Apr. 6, 1976

[54] DEVICE FOR APPLYING A DETERMINED FORCE TO AN ELEMENT CONNECTED TO AN INSTALLATION SUBJECTED TO ALTERNATING MOVEMENTS

[75] Inventors: Gerard Jourdan, Paris; Philippe Joubert, Meudon-la-Foret; Serge Holub, Saint Sebastion-sur-Loire, all of France

[73] Assignee: Institut Francaise du Petrole, des Carburants et Lubrifiants, France

[22] Filed: Sept. 7, 1973

[21] Appl. No.: 395,011

[52] U.S. Cl. ..... 254/172; 60/413

[51] Int. Cl.[2] ..... B66D 1/50

[58] Field of Search ..... 254/172, 173; 175/5, 27; 91/390, 359; 60/413, 418

[56] References Cited

UNITED STATES PATENTS

| | | | |
|---|---|---|---|
| 3,309,065 | 3/1967 | Prad'Homme et al. | 254/172 |
| 3,487,750 | 1/1970 | Borgeson | 91/359 |
| 3,593,824 | 7/1971 | Gregory | 60/413 |
| 3,653,635 | 4/1972 | Bates, Jr. | 254/172 |
| 3,693,939 | 9/1972 | Buckson | 254/172 |
| 3,721,293 | 3/1973 | Ahlstone et al. | 254/172 |
| 3,788,074 | 1/1974 | Castela et al. | 254/172 |
| 3,793,835 | 2/1974 | Larralde | 254/172 |

*Primary Examiner*—Robert J. Spar
*Assistant Examiner*—Kenneth Noland
*Attorney, Agent, or Firm*—Craig & Antonelli

[57] ABSTRACT

This device comprises in combination means for passive compensation of the alternating movements of the installation, comprising at least one articulated jack connected to a source of pressurized fluid, and complementary means for fine compensation, these complementary means activating the passive compensating means in response to the variation of a parameter which characterizes the movements of the installation.

31 Claims, 4 Drawing Figures

Figure 1:
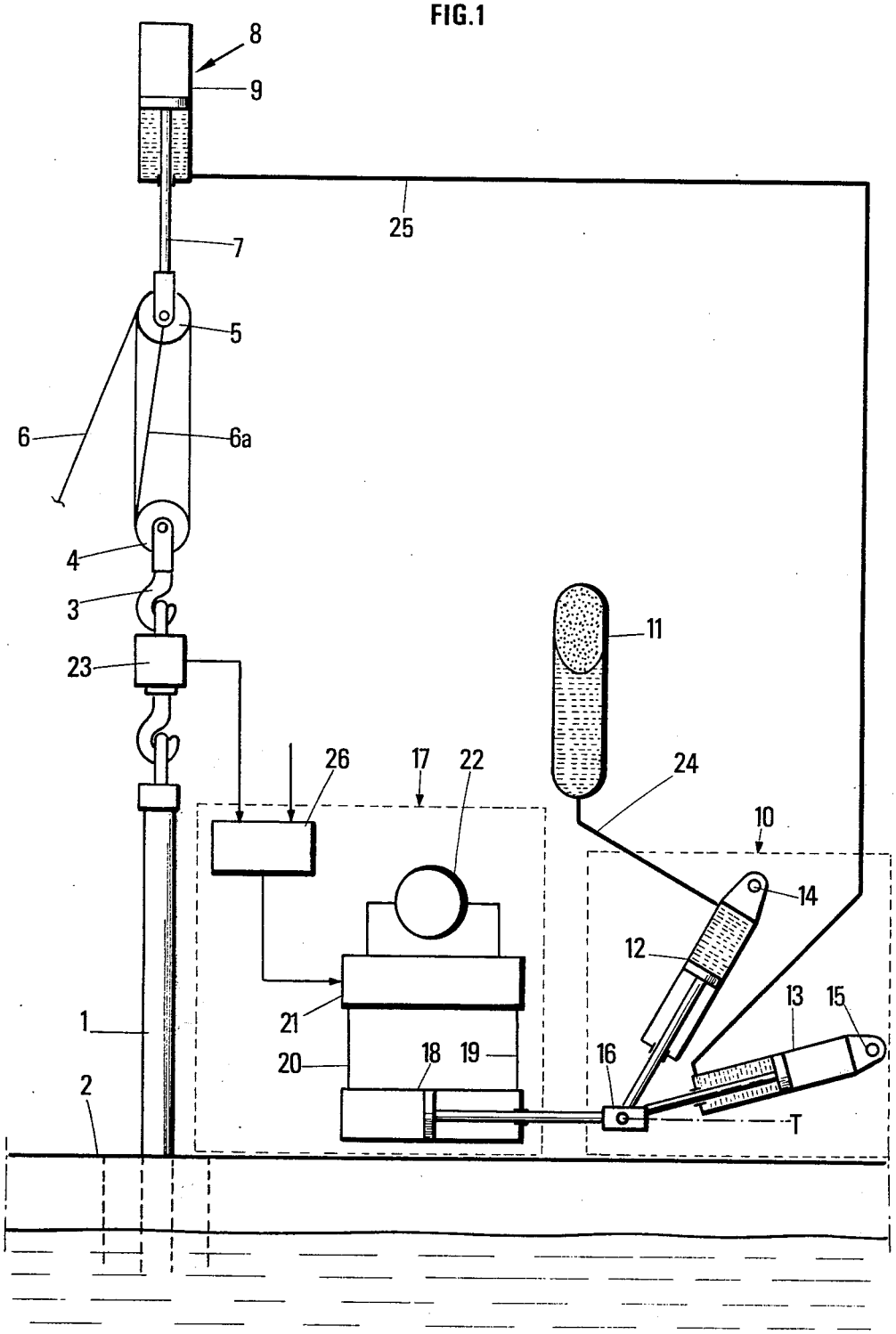

NEW DEVICE FOR APPLYING A DETERMINED FORCE TO AN ELEMENT CONNECTED TO AN INSTALLATION SUBJECTED TO ALTERNATING MOVEMENTS

The invention relates to a new device for applying a determined force to an element connected to an installation subjected to alternating movements. This device is, in particular, suitable for maintaining at a substantially constant value the tension exerted on an elongated element of determined length which connects two points moveable with respect to each other. As a matter of fact, in such a case, the displacement of one of the two points cause variations in the tension of the elongated element, wherefrom result either abnormally high tensile stresses, or values of the tension which are insufficient to properly stretch the elongated element between the two moveable points, when said element consists for example, of a flexible line.

This device is also suitable for preserving a load from the alternating movements of an installation to which this load is connected.

The device according to the invention may have various uses, but in the following, reference will more particularly be made, by way of non-limitative example, to its use for applying to a drill pipe a constant tension so as to prevent this pipe from being subjected to the vertical alternating movements of a floating installation from which the drill pipe is suspended.

The prior art devices generally comprise a vertical suspension jack fixed to the derrick and supporting the drill pipe. This jack is supplied with pressurized fluid, from an oleopneumatic accumulator whose gas stores or delivers power in response to the movements of the floating installation.

For improving the performances of these devices, there is generally used at least one jack having one of its two constituting elements, cylinder or piston rod, articulated about a stationary point and a point of the other element compelled to move along a determined path, so that this jack remains inclined with respect to this path. This inclined jack may either directly apply a compensating force to the drill pipe or constitute an element regulating the pressure of the hydraulic fluid which feeds the suspension jack.

Such devices offer the advantage of being strongly built and of simple design. Their drawbacks lie in the fact that the tension exerted on the drill pipe remains subjected to variations resulting in an alternating movement of the drill pipe, which, while being of reduced amplitude with respect to the movement of the floating installation, may, in some cases, still be deemed too important. It could be possible to make use of a device employing a suspension jack which is supplied with fluid for example from a hydraulic power installation, the pressure of this fluid being kept strictly constant, irrespective of the movements of the floating installation. Such a device, which is too bulky, also suffers from the drawback of requiring too much power and therefor of being too expensive.

The object of the present invention is to provide a new device having the same advantages as the prior art devices, i.e. making use of a gas which stores or releases power in response to the movements of the installation, this passive compensating system being combined with a complementary system for fine compensation which "activates" the passive compensating system, as a function of the measured value of at least one parameter selected among the parameters whose values are functions of the amplitude of the movements of the installation.

Figure 2:
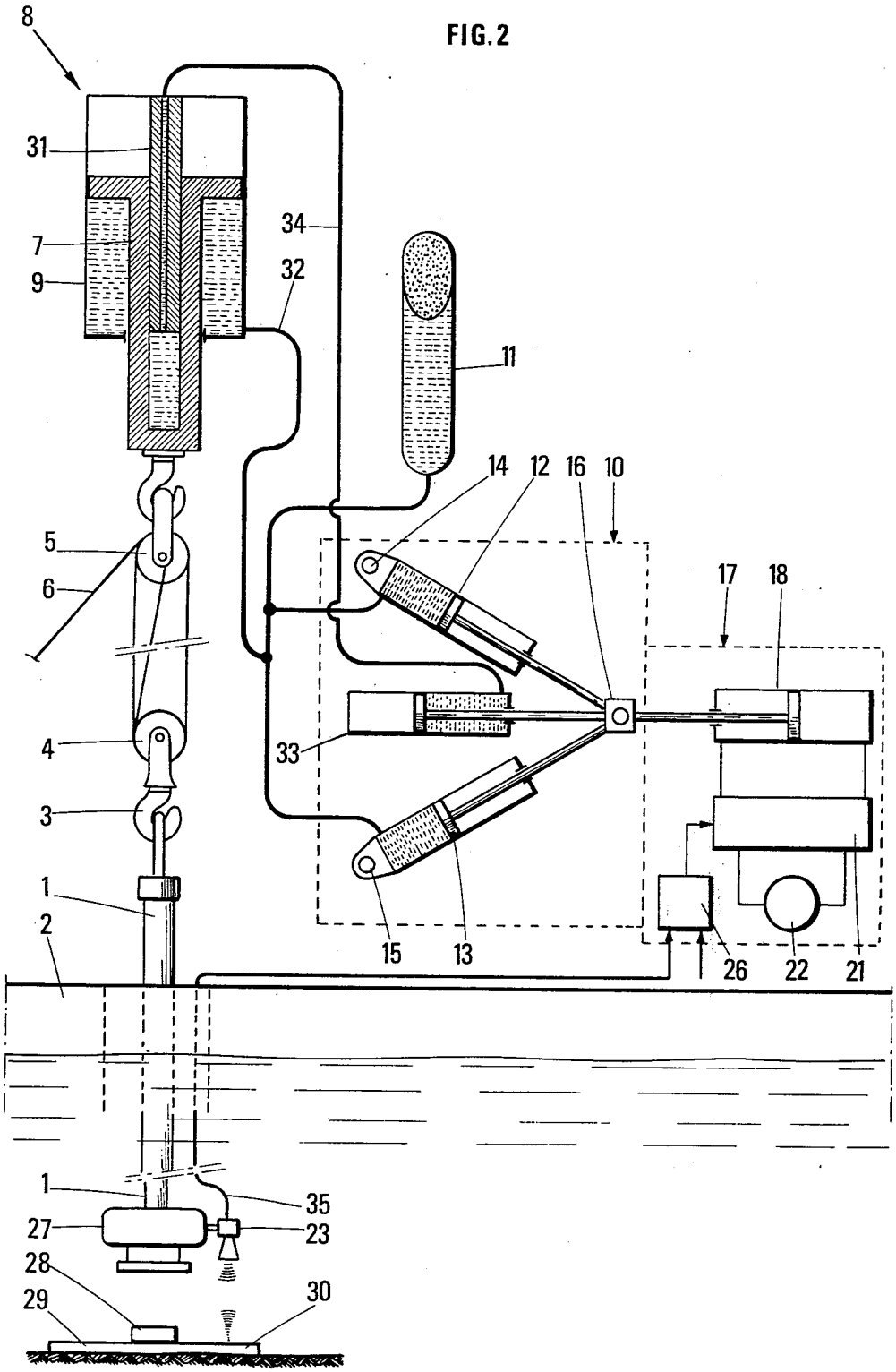
Figure 3:
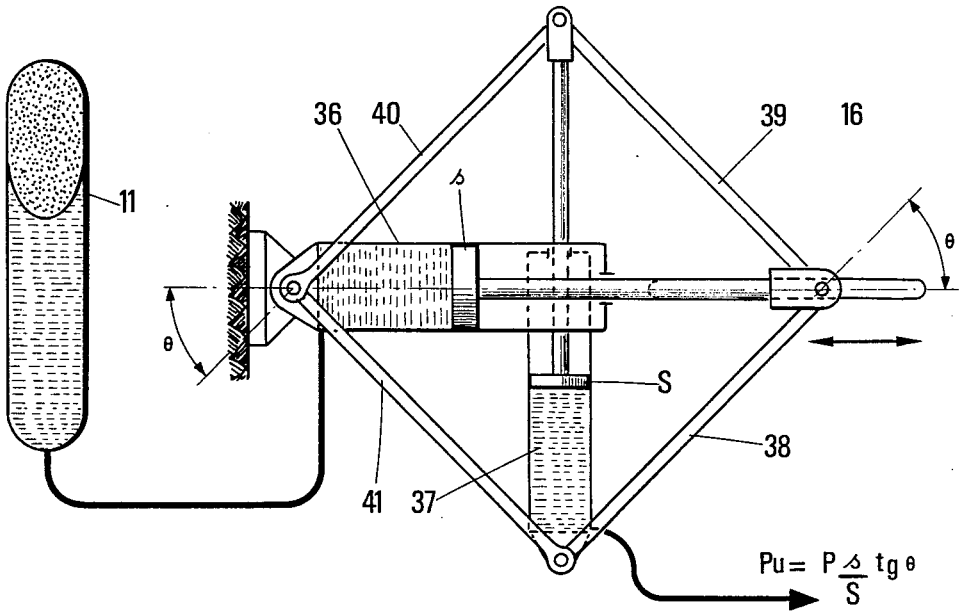
Figure 4:
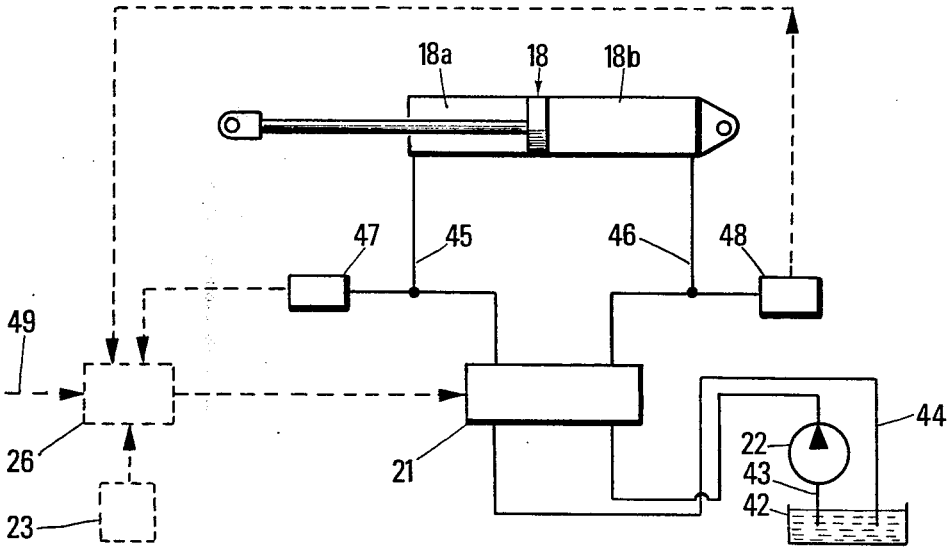

The invention will be well understood and other advantages thereof will appear upon reading the following description of non-limitative embodiments thereof, illustrated by the accompanying drawings, wherein:

FIG. 1 diagrammatically illustrates an embodiment of the invention, used for preventing a drill pipe from being subjected to the alternating vertical movements of the floating installation from which this pipe is suspended, FIG. 2 diagrammatically shows a modification of the device illustrated by FIG. 1, used for laying a heavy load onto the sea bottom, FIG. 3 shows another type of a pressure regulating system, suitable for supplying the suspension jack with hydraulic fluid and, FIG. 4 shows more in detail an embodiment of a complementary system for fine compensation.

FIG. 1 diagrammatically illustrates a non-limitative embodiment of the device according to the invention used for preventing a drill pipe from being subjected to the alternating vertical movements of a floating installation 2 to which the drill pipe is connected.

The upper end of the drill pipe 1 is secured to the hook 3 of a travelling block which is suspended from a crown block 5 through a handling cable 6. The crown block 5 is integral with one of the two elements (for example with the piston rod 7) of the main suspension jack 8, the other element of the jack 8 (the cylinder 9) being fixed on a derrick (not shown), carried by the floating installation 2.

The suspension jack 8 is supplied with pressurized hydraulic fluid through a pressure regulating system designated as a whole by reference numeral 10, which is itself fed with hydraulic fluid from a battery of oleopneumatic accumulators diagrammatically shown at 11.

This regulating system 10 comprises, for example, as shown in FIG. 1, a pair of regulating jacks 12 and 13 articulated at one of their ends about stationary points 14 and 15 respectively, the other ends of these jacks being articulated on a moveable member which is displaceable along a path T, for example a rectilinear path, so determined that at least one of said two jacks always forms an angle with this path, said angle varying as a function of the vertical displacement of the installation 2 and characterizing the geometrical configuration of the regulating system. The jack 12 is connected to the accumulator 11 through the pipe 24, while the cylinders of the jacks 8 and 13 communicate with each other through the hydraulic pipe 25.

The assembly of the above-described elements forms a passive compensating system which applies to the drill pioe 1 a substantially constant tensile force by using the pressure of a gas contained in the accumulator 11, which stores or delivers power in response to the alternating vertical movements of the floating installation 2, the variations in the gas pressure being corrected by a factor whose value is derived from a trigonometric function of the above-defined variable angle.

According to the invention, there is combined with this passive compensating system a complementary system for fine compensation which is designated as a whole by reference numeral 17. This system 17 adjusts and improves the action of the passive compensating device as a function of the measured value of at least one parameter selected among the parameters whose values are functions of the vertical displacements of the floating installation 2.

This complementary system 17 for fine compensation comprises a double-acting jack 18, having one of its constituting elements articulated onto the moveable member 16, a source of pressurized fluid 22, connected to the jack 18 through the pipes 19 and 20 and a device, diagrammatically shown at 21, controlling the value of the pressure difference between the two chambers of the jack 18, independently of the displacement of the piston of jack 18, as a function of the value of a control signal generated by a comparing circuit 26 to which is applied a first signal generated by a detector or sensor 23 and a second signal which is called order or reference signal.

The value of the control signal results from the comparison of the signals received by the detector 23. The value of the signal generated by the detector 23 depends on the measured actual value of a parameter selected from a group of parameters whose values are functions of the displacement of the floating installation 2 and the value of the order signal is a function of a determined value of a parameter selected from the group of the above-defined parameters, the correlation between the measured parameter and that represented by the order signal being known.

The operation of the device is as follows:

Under the swell action, the floating installation 2 moves vertically over a height $\Delta h$, which tends to vary the tension in the drill pipe. This vertical movement results in a relative displacement of the piston of the jack 8 in the cylinder 9. The corresponding variation in the volume of hydraulic fluid in the jack 8 is transmitted to the jack 13 through pipe 25 and the moveable member 16 is displaced along the path T over a such distance that the variation in the tension resulting from the movement $\Delta h$ of the floating installation is substantially compensated for.

However, since the compensation provided by this device alone is not perfect, a small variation in the tension of the pipe 1 can be observed, because the pressure variations in the accumulator 11 are not entirely compensated by the variations in the inclination of the jacks 12 and 13 with respect to the path T.

In order to remove this source of inaccuracy, the detector 23 simultaneously measures the actual value of a parameter which is a function of the movement of the floating installation 2 and transmits a corresponding signal to the comparison circuit 26 which generates a control signal as above indicated.

In response to the control signal, the device 21 adjusts the fluid pressure in each of the chambers of jack 18, i.e. regulates the difference between the pressures acting respectively on the two faces of the piston of the jack 18, at a value such that the rod of this jack displaces the moveable member 16 along the path, thus varying the pressure in the jack 13 until the value of the control signal takes again the value it had before the occurence of the vertical movement $\Delta h$ of the floating installation, i.e. such that the tensile force in the drill string does not vary.

In the embodiment illustrated by FIG. 1, the parameter measured by detector 23 is the pulling force exerted by the hook 3 on the drill pipe 1. In this case the detector 23 is a load detector placed between the drill string 1 and the hook 3 of the travelling block. This detector may be of any known type, comprising for example strain gauges, and delivers a signal whose value is a function of the pulling force and consequently of the tension exerted on the drill pipe. The value of the reference or order signal applied to the comparing circuit 26 is a function of the determined value of the tension which has to be kept constant.

The load detector 23 may be replaced by strain gauges provided on the drill pipe 1 or on the portion 6a of cable 6, but in this last embodiment the measurement must be corrected so as to take into account the friction on the sheaves of blocks 4 and 7 as the drilling operation progresses.

The parameter measured by the detector 23 and the parameter represented by the reference or order signal may be selected from the following non-limitative list of the parameters whose values are functions of the vertical movements of the floating installation:

velocity of the installation along the direction of its alternating movements, this velocity being measured with respect to a stationary reference system of coordinate axes. In the case of a floating installation this velocity will be its vertical velocity or displacement, which is for example measured with respect to the sea bottom;

tension exerted on the elongated member, such as a drill string;

distance between the element connected to the installation and a stationary point.

In the case of a floating installation, this distance, will, for example, be the distance between a point of the drill string and the sea bottom;

value of the acceleration of the installation along its direction of movement;

pressure of the hydraulic fluid in the suspension jack, etc.

Some devices are described hereinunder, adapted for measuring the actual value of one of these parameters, but obviously other devices may be used without departing from the scope of the invention.

a. Current flowmeter (device measuring the velocity in a liquid) which may be of any known type, may be secured to the drill pipe, when in the body of water traversed by the drill pipe no sea current having a vertical component can interfere with the measurement of the flowmeter, which then gives the vertical speed of the drill string.

An integrating circuit may be associated with this flowmeter, so as to obtain a signal which is a function of the distance between one point of the drill string and a stationary point, for example located on the water bottom.

It will also be possible to associate to this flowmeter a derivating circuit so as to obtain a signal which is a function of the vertical acceleration of the drill pipe.

b. Acoustic transmitter-receiver: an acoustic transmitter-receiver of the sonar type may be secured to the drill pipe, the acoustic waves being reflected by the water bottom, the data provided by the sonar permitting determination of the distance between one point of the drill string and, for example, the water bottom.

With this sonar may be associated a derivating circuit for obtaining a signal which is a function of the vertical velocity of the drill string or a double derivating circuit delivering a signal which is a function of the vertical acceleration of the drill string.

c. Load transducer or sensor: the tensile stress exerted on the drill string may be determined as previously indicated by using a transducer which comprises, for example, strain gauges, and is either placed between the drill string and the hook of the travelling block or is operatively associated with the drill string or with the handling cable.

d. Pressure transducer: a pressure sensor which may be of any known type may measure the pressure of hydraulic fluid in the suspension jack.

The selection of the measured parameter will be made by those skilled in the art as a function of the performances of the available transducers and of the desired result, since the accuracy of the device according to the invention is obviously dpeendent, in particular, on the sensitivity of the transducer.

The signals applied to the comparator 26 may be a function of the measured value and of the predetermined order or reference value of a given parameter or also of different parameters, the correlation between these parameters being known.

The comparator 26 may then comprise a circuit for correlating the signals.

FIG. 2 diagrammatically illustrates another embodiment of the device which is used for laying a heavy load, such as, for example, an element 27 for obturating a well known as a B.O.P (Blow out Preventer), onto a well head diagrammatically illustrated at 28, whose base plate lies on the water bottom 30.

The B.O.P. 27 is secured at the lower end of a handling string, which is, for example, constituted by the drill string 1.

The guide lines, or other conventional means for guiding the BOP during the lowering thereof have not been shown in the drawing for sake of clarity. The drill string 1 is suspended from the hook 3 of a travelling block 4 connected to the stationary crown block 5 through the handling cable 6.

The crown block 5 is supported by the rod 7 of the jack 8 whose cylinder 9 is fixed on the derrick (not shown) which is carried by the floating installation 2. The rod 7 is provided with an axial bore which constitutes, together with a rod 31 integral with the cylinder 9, an auxiliary jack.

The jack 8 and this auxiliary jack form the main suspension jack means.

Through a pipe 32, an oleopneumatic accumulator 11 feeds in parallel the suspension jack means and a regulating system designated as a whole by reference numeral 10. This system comprises two jacks 12 and 13 articulated at one of their ends about stationary points 14 and 15 respectively. The other ends of these jacks are articulated onto a moveable member 16 compelled to move along a determined path. The two jacks 12 and 13 are fed with hydraulic fluid from the accumulator 11.

The moveable member 16 is connected to one of the elements of a third jack 33 which supplies with pressurized hydraulic fluid, through pipe 34, the auxiliary jack formed by the rod 31 and the axial bore of the rod 7. When the floating installation moves vertically, the auxiliary jack fed by the regulating system 10 applies to the piston rod 7 of jack 8 a force correcting the action exerted by the suspension jack 8.

With this device is associated a complementary system 17 for fine compensation, which is identical to that illustrated by FIG. 1 and whose double acting jack 18 acts upon the moveable member 16.

The comparating circuit 26 receives an order or reference signal representing the value of the distance which must be maintained between the B.O.P. 27 and the water bottom. This value may be adjustable.

The detector 23, which may be of the "sonar" type sends acoustic waves which are reflected, for example, on the sea bottom whereby is determined the vertical distance between the B.O.P. and the water bottom. The signal delivered by the transducer 26 is transmitted through a conductor 35, which can be incorporated in the drill pipe, to the comparator 26 wherein this signal is compared with the reference signal.

The operation of this assembly is the same as for FIG. 2.

As it is apparent from the above description, the suspension jack 8 and the regulating system 10 which constitutes the passive compensating means, readily provides for some compensation of the vertical movements due to the action of swell, and therefore, in case of failure or bad operation of the complementary compensation system 17, the action of the alternating vertical movements will always be at least partially compensated. Furthermore, during the operations for positioning a B.O.P., for example, the first part of the lowering of this B.O.P., between the floating installation and the water bottom, may be achieved with the sole action of the passive compensation means, since a strict accuracy is not absolutely necessary during this step, the complementary system 17 for fine compensation thus activating these passive compensating means only during the final step of positioning the B.O.P.

It should be noted, in particular, that the power delivered by the complementary system 17 for fine compensation is relatively small, since the greater part of the energy of the alternating movements of the moveable installation is compensated by the passive compensating means.

Modifications may be brought without departing from the scope of the invention.

In the embodiments illustrated in FIGS. 1 and 2, the regulating system 10, including an arrangement of jacks whose geometrical configuration is variable due to the pivoting of at least some of these jacks, acts on the pressure of the hydraulic fluid feeding the suspension jack.

This embodiment is interesting since only the suspension jack is placed at the top of the derrick, while the other jacks may be located at a place where they do not or only slightly affect the equilibrium of the floating installation.

In some cases, however, such as for example, in the embodiment illustrated in U.S. Pat. No. 3,285,574, the jacks with a variable geometry of the regulating system directly exert a compensating force on the element secured to the suspension jack. In this case, the jack 18 of the complementary system 17 for fine compensation will also apply a force on the element suspended from the jack 8.

FIG. 3 illustrates another type of a pressure regulating system 10 which may be substituted for the one represented in FIG. 1.

It comprises two perpendicular jacks 36 and 37 whose pistons have respectively cross-sections S and s and whose ends are connected through articulated rods 38 and 41 forming a rhomb. The jack 36 is connected to the oleopneumatic jack 11 while the jack 37 feeds the suspension jack 8 of FIG. 1 with hydraulic fluid whose pressure Pu is equal to the product of the pressure P in the accumulator by a correcting factor proportional to a trigonometric function of a variable angle $\theta$ $$Pu = P \frac{s}{S} \tan \theta$$

The device according to the invention can find applications in particular for operations at sea and will be perfectly suitable for transferring a heavy load between two installations at least one of which is subjected to alternating movements.

FIG. 4 shows a particular embodiment of the complementary system for fine compensation having the reference 17 in FIGS. 1 and 2.

This system comprises a source 22 of pressurized fluid constituted by a pump connected to the tank 42 through the pipe 43 and to a device 21 which is constituted by a servo-valve which is directly connected to the tank 42 through the pipe 44. According to the position of the servo-valve, the hydraulic fluid supplied by the pump 22 feeds either of chambers 18 *a* and 18 *b* of the jack 18, through pipes 45 or 46. The flow rate of hydraulic fluid in these pipes is adjusted through the servo-valve 21.

The fluid pressure in each chamber 18 *a* and 18 *b* is measured by pressure transducers 47 and 48, respectively connected to pipes 45 and 46.

In this embodiment the comparing circuit 26 is constituted by an electronic circuit which receives on one of its input terminals the electric signal delivered by the detector 23 and which comprises regulating means (indicated by reference 49) of the reference or order signal.

Each of the pressure sensors 47 and 48 delivers a signal representative of the pressure in the chamber of the activating jack with which this pressure sensor communicates. The signals of these sensors are applied to the circuit 26 which delivers a control signal actuating the servo-valve 21.

The flow rate of hydraulic fluid through the servo-valve is adjusted at such a value that the difference between the respective hydraulic fluid pressures in the two chambers of the activating jack 18 causes a displacement of the piston of this jack and consequently of the member 16 (FIG. 1) which completely nullify the pressure variations in the suspension jack 8, in other words the variations in the parameter measured by the sensor 23.

It would obviously be possible to substitute for the two pressure sensors 47 and 48 a single differential sensor delivering to the circuit 26 a signal representative of the pressure difference between the two chambers of jack 18.

What we claim is:

1. A device for applying a determined force to an element connected to an installation subjected to alternating movements, comprising, in combination, means for passive compensation which applies compensating forces to the element in response to the alternating movements, and complementary means for effecting fine compensation of said compensating forces of said passive compensating means, said means for passive compensation being subjected to the action of a mass of gas whose volume and pressure vary as a function of the movements of the installation, said passive compensating means comprising at least one jack fed with fluid under pressure through said mass of gas, said jack exerting on the element a force whose value is proportional to the value of the pressure of said mass of gas, said passive compensating means being disposed in a geometrical configuration for applying a correcting factor to pressure variations in said mass of gas to effect said compensating forces, said correcting factor having a value depending on a trigonometric function of at least one variable angle of said geometrical configuration of said passive compensating means, said complementary means for effecting fine compensation actuating said one jack of said passive compensating means in response to the actual value of at least one measured parameter selected among the parameters whose values are a function of the movements of the installation.

2. A device according to claim 1, wherein said complementary means varies said variable angle such that said correcting factor is varied in accordance with said measured parameter, thereby compensating for pressure variations of said mass of gas.

3. A device for applying a determined force on an element connected to an installation subjected to alternating movements, comprising in combination passive compensating means which applies compensating forces to the element in response to the alternating movements, and complementary means for effecting fine compensation of said compensating forces of said passive compensating means, said passive compensating means comprising at least one jack connected to at least one accumulator of pressurized fluid, said at least one jack having at least one element displaceable under the action of the alternating movements of the installation, said passive compensating means being disposed in a geometrical configuration for applying a correcting factor to pressure variations in said accumulator to effect said compensating forces, said correcting factor having a value depending on a trigonometric function of at least one variable angle of said geometrical configuration of said passive compensating means, said complementary means for accurate compensation actuating said one jack of said passive compensating means in response to the actual value of at least one measured parameter selected among the parameters whose values are functions of the alternating movements of the installation.

4. A device according to claim 3, wherein said complementary means varies said variable angle such that said correcting factor is varied in accordance with said measured parameter, thereby compensating for pressure variations of said accumulator.

5. A device for applying a determined force to an element connected to an installation subjected to alternative movements, comprising in combination passive compensating means for applying compensating forces to the element in response to the alternate movements and complementary means for effecting fine compensation of said compensating forces of said passive compensating means in response to the actual value of at least one measured parameter being a function of the alternating movements of the installation, said passive compensating means comprising at least one jack connected to at least one accumulator of pressurized fluid, said at least one jack having at least one element displaceable under the action of said alternating movements, and said passive compensating means being disposed in a geometrical configuration for applying a correcting factor to pressure variations in said accumulator to effect said compensating forces, said correcting factor having a value depending on a trigonometric function of at least one variable angle of said geometrical configuration of said passive compensating means, said complementary means being coupled to said one jack for varying said geometrical configuration of said passive compensating means in order to vary said correcting factor such that said fine compensation of said compensating forces are effected.

6. A device according to claim 5, wherein said complementary means for effecting fine compensation comprise a source of pressurized fluid, a double acting jack having two chambers each fed with said pressurized fluid from said source, a regulating element controlling the flow of said fluid into said two chambers of said double acting jack, sensor means for generating a first signal which is a function of said at least one measured parameter, an electric circuit receiving on the one hand said first signal and, on the other hand, a second signal which is a function of a predetermined value of said parameter selected among all parameters having values which are functions of the alternating movements of the installation, said circuit delivering a control signal representative of the result of the comparison of said first and second signals, said control signal being applied to said regulating element.

7. A device according to claim 6, wherein said jack of said passive compensating means applies on the element connected to the installation a force having a direction substantially parallel to the direction of the alternating movements of the installation, said at least one jack being fed with pressurized fluid, said passive compensating means further comprising means for regulating the pressure of said pressurized fluid feeding said at least one jack, said regulating means comprising at least one pair of regulating jacks, at least one of said regulating jacks of said pair having at least one constituting element articulated on a moveable member compelled to move along a predetermined path, providing change of said variable angle when the installation is subjected to the alternating movements, said double acting jack of said complementary means including at least one first element being articulated on said moveable member to vary the movement of said moveable member on its path as a function of the value of said control signal.

8. A device according to claim 7, used for preserving said element, connected to the floating installation, from the action of vertical movements of said floating installation, wherein said sensor means includes a current flowmeter fixed on said element connected to the installation, said current flowmeter being adapted to generate a signal which is a function of the vertical velocity of said element connected to the installation relative to the water bottom.

9. A device according to claim 7, wherein said sensor means includes of a transmitter-receiver of acoustic waves, which are reflected by a reference system.

10. A device according to claim 7, wherein said sensor means includes a force detector.

11. A device according to claim 10, wherein said force detector is associated with said at least one jack of said passive compensating means and generates a signal which is a function of the force exerted by said at least one jack on the element connected to said installation.

12. A device according to claim 10, wherein said force detector is placed between the element connected to the installation and said at least one jack of said passive compensating means.

13. A device according to claim 10, wherein said force detector is associated with said element connected to the installation, so as to directly measure the force applied to said element.

14. A device according to claim 10, wherein said element connected to the installation is coupled to said at least one jack of said passive compensating means through a flexible line for handling said element, and said force detector is associated with the handling line to directly measure the force applied on said handling line.

15. A device according to claim 10, wherein said force detector includes at least one strain gauge.

16. A device according to claim 7, wherein said sensor means includes an accelerometer fixed to said element connected to the installation, said accelerometer delivering a signal which is a function of the acceleration of said element in the direction of the alternating movements of the installation.

17. A device according to claim 7, wherein said sensor means includes a pressure sensor which measures the pressure of said pressurized fluid feeding said at least one jack of said passive compensating means.

18. A device according to claim 6, wherein said at least one jack applies on said element connected to the installation a force having a component whose direction is substantially parallel to that of the alternating movements of this installation, said at least one jack having at least one first element articulated about a point stationary with respect to the installation, and said at least one jack having at least one second element with a point of said second element being moveable along a rectilinear path having a direction substantially parallel to that of the alternating movements of the installation, said at least one jack forming said variable angle with said path, and said double acting jack of said complementary means having at least one first element articulated onto said element connected to the installation so as to apply to this element a force in the direction of the alternating movements of the installation.

19. A device according to claim 18, used for preserving said element connected to the floating installation from the action of vertical movements of said floating installation, wherein said sensor means includes a current flowmeter fixed on said element connected to the installation, said current flowmeter being adapted to generate a signal which is a function of the vertical velocity of said element connected to the installation relative to the water bottom.

20. A device according to claim 18, wherein said sensor means includes a transmitter-receiver of acoustic waves, which are reflected by a reference system.

21. A device according to claim 18, wherein said sensor means includes a force detector.

22. A device according to claim 21, wherein said force detector is associated with said at least one jack of said passive compensating means and generates a signal which is a function of the force exerted by said at least one jack on the element connected to said installation.

23. A device according to claim 21, wherein said force detector is placed between the element connected to the installation and said at least one jack of said passive compensating means.

24. A device according to claim 21, wherein said force detector is associated with said element connected to the installation, so as to directly measure the force applied to said element.

25. A device according to claim 21, wherein said element connected to the installation is coupled to said at least one jack of said passive compensating means through a flexible line for handling said element, and said force detector is associated with the handling line to directly measure the force applied on said handling line.

26. A device according to claim 21, wherein said force detector includes at least one strain gauge.

27. A device according to claim 18, wherein said sensor means includes an accelerometer fixed to said element connected to the installation, said accelerometer delivering a signal which is a function of the acceleration of said element in the direction of the alternating movements of the installation.

28. A device according to claim 18, wherein said sensor means includes a pressure sensor which measures the pressure of said pressurized fluid feeding said at least one jack of said passive compensating means.

29. A device for applying a determined force on an element connected to an installation subjected to alternating movements, comprising in combination passive compensating means and complementary means for fine compensation of these alternating movements, said passive compensating means comprising at least one jack connected to at least one accumulator of pressurized fluid, said jack having at least one element displaceable under the action of the alternating movements of the installation, these passive compensating means applying to the pressure variations in said accumulator a correcting factor whose value depends on a trigonometric function of at least one variable angle characterizing the geometrical configuration of said passive compensating means, said complementary means for accurate compensation actuating said passive compensating means in response to the actual value of at least one measured parameter selected among the parameters whose values are functions of the alternating movements of the installation, wherein said complementary means for fine compensation comprise a source of pressurized fluid, a double acting jack having two chambers each fed with said pressurized fluid from said source, a regulating element controlling the flow of said fluid into said two chambers of said double acting jack, sensor means generating a first signal which is a function of said measured parameter, an electric circuit receiving on the one hand said first signal and, on the other hand, a second signal which is a function of a determined value of a parameter selected among the parameters whose values are functions of the alternating movements of the installation, said circuit delivering a control signal representative of the result of the comparison of said first and second signals, said control signal being applied to said regulating element, wherein said regulating element is a servovalve and comprises control means adapted to deliver to said electric circuit a signal whose value is a function of the difference between the fluid pressures in said two chambers of said double acting jack.

30. A device according to claim 29, wherein said control means comprise two pressure sensors, each of said two pressure sensors measuring the pressure in one of said chambers of said double acting jack.

31. A device according to claim 29, wherein said control means consist of a differential pressure sensor connected to both chambers of said double acting jack.

* * * * *